US006305865B1

(12) United States Patent
Yoshii et al.

(10) Patent No.: US 6,305,865 B1
(45) Date of Patent: Oct. 23, 2001

(54) PUSH BUTTON TYPE BALLPOINT PEN

(75) Inventors: Kazuhiro Yoshii; Kazuhiko Sasaki; Takashi Ohno, all of Isesaki (JP)

(73) Assignee: Kabushiki Kaisha Pilot, Tokyo-To (JP)

( * ) Notice: Subject to any disclaimer, the term of this patent is extended or adjusted under 35 U.S.C. 154(b) by 0 days.

(21) Appl. No.: 09/529,855

(22) PCT Filed: Aug. 20, 1999

(86) PCT No.: PCT/JP99/04476

§ 371 Date: Apr. 20, 2000

§ 102(e) Date: Apr. 20, 2000

(87) PCT Pub. No.: WO00/10812

PCT Pub. Date: Mar. 2, 2000

(30) Foreign Application Priority Data

| | | |
|---|---|---|
| Aug. 21, 1998 | (JP) | 10-235709 |
| Sep. 3, 1998 | (JP) | 10-249279 |
| Sep. 4, 1998 | (JP) | 10-250779 |

(51) Int. Cl.[7] ..... B43M 11/02
(52) U.S. Cl. ..... 401/219; 401/209
(58) Field of Search ..... 401/208, 209, 401/212, 214, 216, 217, 219, 232, 236; 138/44

(56) References Cited

U.S. PATENT DOCUMENTS

| | | | | |
|---|---|---|---|---|
| 2,708,903 | * | 5/1955 | Fehling | 401/209 |
| 5,929,135 | * | 7/1999 | Wasai et al. | 401/209 |
| 5,984,559 | * | 11/1999 | Shiobara et al. | 401/214 |
| 6,024,129 | * | 2/2000 | Schima | 138/44 |
| 6,062,756 | * | 5/2000 | Sasaki | 401/111 |

FOREIGN PATENT DOCUMENTS

| | | | | |
|---|---|---|---|---|
| 461361 | * | 12/1913 | (FR) | 401/214 |
| 1012842 | * | 4/1952 | (FR) | 401/214 |
| 1175860 | * | 1/1970 | (GB) | 401/214 |
| 46-27050 | | 9/1971 | (JP) . | |
| 49-30037 | | 3/1974 | (JP) . | |
| 5058090 | * | 3/1993 | (JP) | 401/214 |
| 8-310184 | | 11/1996 | (JP) . | |
| 9-175079 | | 7/1997 | (JP) . | |
| 10-58887 | | 3/1998 | (JP) . | |

* cited by examiner

*Primary Examiner*—David J. Walczak
*Assistant Examiner*—Tuan Nguyen
(74) *Attorney, Agent, or Firm*—Wenderoth, Lind & Ponack, L.L.P.

(57) ABSTRACT

A retractable ballpoint pen is free from leakage of ink from its tip and ink back-flow attributable to shocks produced by retractable operation, and is capable of satisfactory writing performance. The retractable ballpoint pen has a ballpoint pen refill (3) having a ballpoint pen tip (7) disposed in a forward end of an ink-accommodating tube (8), a ball (9) held for free rotation in a forward end part of the ballpoint pen tip (7). The retractable ballpoint pen is provided with a retracting mechanism (5, 6) for projecting a forward end of the ballpoint pen tip (7) and retracting the same through an open forward end (2a) of a barrel (2). A water-based ink (15) contained in the ink-accommodating tube (8) contains a thixotropic agent and has a viscosity at a rate of shear of 1.9 $sec^{-1}$ at 20° C. in the range of 900 to 2500 mPa·s. A restricting passage (20) is formed in a passage for the water-based ink (15) contained in the ink-accommodating tube (8) to flow to the ball (9) and has a cross-sectional area measured perpendicular to the axis of the ink-accommodating tube (8) in the range of 0.4 to 0.8 $mm^2$. The restricting passage (20) limits the flow of the water-based ink (15).

17 Claims, 5 Drawing Sheets

PUSH BUTTON TYPE BALLPOINT PEN

TECHNICAL FIELD

The present invention relates to a retractable ballpoint pen provided with a ballpoint pen refill having an ink-accommodating tube containing water-based ink and having a ballpoint pen tip capable of being projected from and retracted into a barrel through an open forward end of the barrel by operating a retracting mechanism.

BACKGROUND ART

A well-known retractable ballpoint pen is provided with a ballpoint pen refill having a ballpoint pen tip capable of being projected from and retracted into a barrel through an open forward end of the barrel. This retractable ballpoint pen has a ballpoint pen refill containing writing ink which is inserted in the barrel for sliding movement in the barrel and biased toward the rear end of the barrel by a spring. This retractable ballpoint pen has a retracting mechanism for projecting the ballpoint pen tip from and retracting the same into the barrel through the open forward end of the barrel.

A retractable ballpoint pen with a ballpoint pen refill having an ink-accommodating tube containing water-based ink has been marketed in recent years.

The ballpoint pen tip of the retractable ballpoint pen with the ballpoint pen refill having the ink-accommodating tube containing water-based ink is pointed downward when the retractable ballpoint pen is held in a pocket of clothes with a clip. Consequently, problems are liable to arise due to leakage or back-flow of ink. Back-flow of ink is a phenomenon in which the ink flows rearward from the ballpoint pen tip into the ink-accommodating tube due to shocks caused by the operation of a retracting mechanism or dropping.

The present invention has been made in view of the above-mentioned problems. It is therefore an object of the present invention to provide a retractable ballpoint pen with a ballpoint pen refill having an ink-accommodating tube containing water-based ink inserted in a barrel. The pen is free of ink leakage from its tip and free of ink back-flow due to shocks caused by retractable operation, and the pen is also satisfactory in writing performance.

SUMMARY OF THE INVENTION

To achieve the object, the present invention provides a retractable ballpoint pen comprising: a ballpoint pen refill having an ink-accommodating tube, a ballpoint pen tip disposed in a forward end of the ink-accommodating tube, and a ball held for free rotation in a forward end of the ballpoint pen tip; a barrel having an open forward end and containing the ballpoint pen refill; a retracting mechanism for projecting and retracting a forward end of the ballpoint pen tip through an open forward end of the barrel; a water-based ink contained in the ink-accommodating tube, the water-based ink containing a thixotropic agent and having a viscosity at a rate of shear of 1.9 $sec^{-1}$ at 20° C. in the range of 900 to 2500 mPa·s; and a restricting passage for restricting a flow of the water-based ink. The restricting passage is formed in a passage so that the water-based ink contained in the ink-accommodating tube can flow to the ball, and a sectional area of the restricting passage measured perpendicular to an axis of the ink-accommodating tube is in a range of 0.4 to 0.8 $mm^2$.

Preferably, the retractable ballpoint pen further comprises a tip holder attached to a forward end part of the ink-accommodating tube. The tip holder holds a rear end of the ballpoint pen tip in the forward end part, and the tip holder is provided with an ink passage. The restricting passage is formed by reducing at least a part of the ink passage. Preferably, the restricting passage is formed in a rear end of the ink passage.

Preferably, the ink passage is tapered from a front end of the tip holder toward a rear end of the tip holder, and the restricting passage is formed at a narrowest rear end of the ink passage.

Preferably, the retractable ballpoint pen comprises a coil spring pressing the ball forward to press the ball closely against an inner surface of the forward end part of the ballpoint pen tip. The tip holder has an aperture at its forward end part, and a rear end of the ballpoint pen tip is fitted in the aperture. The aperture of the tip holder is connected to the ink passage, and is formed to have a diameter greater than a diameter of the ink passage so as to form a shoulder at a joint of the aperture and the ink passage to hold a rear end of the coil spring thereon.

Preferably, the retractable ballpoint pen further comprises a tip holding part formed integrally with a forward end of the ink-accommodating tube. The tip holding part is provided with an ink passage, and the restricting passage is formed by reducing at least a part of the ink passage of the tip holding part.

Preferably, the retractable ballpoint pen further comprises a flow control member with an ink passage, wherein the ink-accommodating tube has a small-diameter section formed at the forward end, and a large-diameter section formed behind the small-diameter section. The large-diameter section has a diameter larger than a diameter of the small-diameter section, and the ballpoint pen tip is attached to a forward end of the small-diameter section. The flow control member is fitted in the small-diameter section, and the restricting passage is formed by setting the smallest cross-sectional area of the ink passage of the flow control member at a value in a range of 0.4 to 0.8 $mm^2$.

Preferably, the ballpoint pen tip is attached directly to a forward end of the ink-accommodating tube or to a forward end of a tip holder attached to the forward end of the ink-accommodating tube, and the restricting passage is formed in the ballpoint pen tip. The restricting passage can be formed by bending a rear edge of the ballpoint pen tip inwardly. Alternatively, the restricting passage can be formed by reducing a diameter of a rear end of the ballpoint pen tip along a predetermined length. The restricting passage can also be formed by forming a projection projecting inwardly from an inner surface of a rear end part of the ballpoint pen tip.

Preferably, the retractable ballpoint pen further comprises a flow control member fitted in an open rear end part of the ballpoint pen tip, wherein the restricting passage is formed in the flow control member. The restricting passage can be a continuous hole or a continuous groove extending from a forward end of the flow control member to a rear end thereof, and the hole or the groove has a minimum sectional area in the range of 0.4 to 0.8 $mm^2$. The restricting passage can also be formed by a projection formed on an inner surface of a continuous hole or a continuous groove extending from a forward end of the flow control member to a rear end thereof.

Preferably, the thixotropic agent is a mixture of a crosslinking acrylic acid polymer, a xanthan gum and a succinoglycan. The concentration of the thixotropic agent in the ink is in the range of 0.2 to 0.8% by weight.

The retracting mechanism of the present invention is a well-known writing tip operating mechanism employing a rotary cam, a mechanism that holds a projection in a hole or a mechanism employing a heart cam groove. The retracting mechanism of the present invention may be any one of various mechanisms capable of projecting a forward end of a ballpoint pen tip of a ballpoint pen refill contained in a barrel from an open forward end of the barrel and retracting the same into the barrel when a knocking head is pressed.

The restricting passage according to the present invention may be an aperture of a predetermined length along the direction of the axis of the ink-accommodating tube or may be a local, small part not having the predetermined length. There is no particular restriction on the sectional shape of the restricting passage. The sectional shape of the restricting passage may be either circular or noncircular.

The ink passage according to the present invention may be a straight passage extending along the direction of the axis of the ink-accommodating tube, a meandering passage or a zigzag passage.

There is no particular restriction on the sectional shape of the connecting aperture or the connecting groove of the flow control member. The sectional shape may be either circular or noncircular. The connecting aperture or the connecting groove may extend straight along the direction of the axis of the ink-accommodating tube, may be meandering, may be zigzag or may be tapered.

The retractable ballpoint pen according to the present invention uses a water-based ink having a predetermined viscosity, and limits the flow of the water-based ink by the restricting passage of a predetermined sectional area formed in the passage of the water-based ink. Therefore, the retractable ballpoint pen with the ballpoint pen refill having the ink-accommodating tube containing the water-based ink according to the present invention is free of ink leakage from the tip and of ink back-flow due to shocks produced by the operation of the retracting mechanism etc. and is capable of satisfactorily functioning for writing.

DETAILED DESCRIPTION OF THE INVENTION

Figure 1:
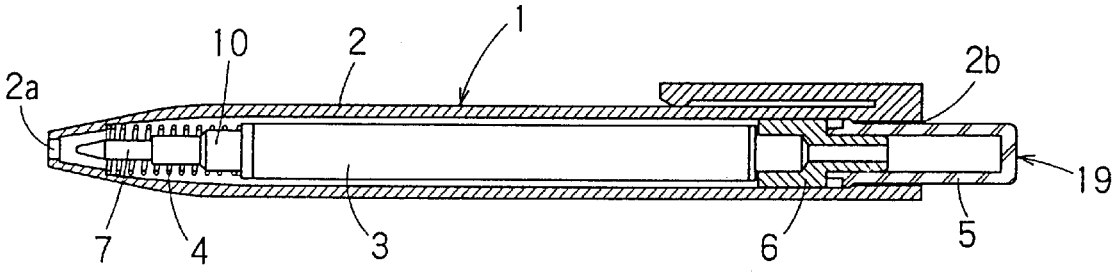
FIG. 1 is a longitudinal sectional view of a retractable ballpoint pen of a first embodiment according to the present invention.

Preferred embodiments of the present invention will be described with reference to the accompanying drawings, in which the same or corresponding members and the same parts are denoted by the same reference characters.

First Embodiment

Referring to FIG. 1 showing a retractable ballpoint pen of a first embodiment according to the present invention, a ballpoint pen refill 3 is inserted for sliding movement in a barrel 2. The ballpoint pen refill 3 is biased toward the rear end of the barrel 2 by a coil spring 4. A well-known retracting mechanism 19 is disposed behind the ballpoint pen refill 3. The retracting mechanism 19 has a knocking head 5 projecting outside from an open rear end 2*b* of the barrel 2, a cam device (not shown) associated with the forward end of the knocking head 5, a rotary cam 6, and a cam groove (not shown) formed in the inner side surface of the barrel 2.

When the knocking head 5 is pressed, the end of a ballpoint pen tip 7 of the ballpoint pen refill 3 contained in the barrel 2 is projected outside through the open forward end 2*a* of the barrel 2.

Figure 2:
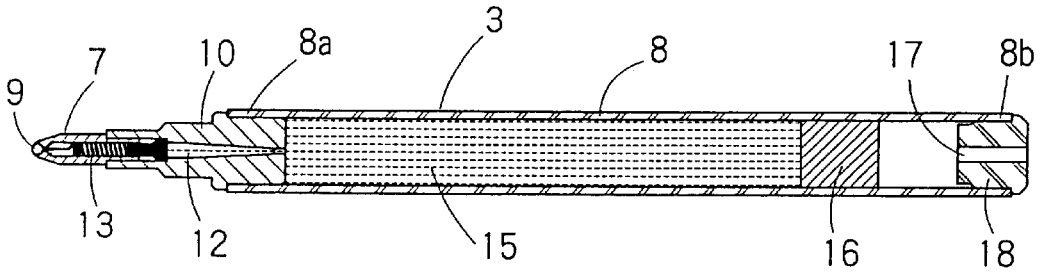
FIG. 2 is a longitudinal sectional view of a ballpoint pen refill inserted in a barrel included in the retractable ballpoint pen shown in FIG. 1.
Figure 3:
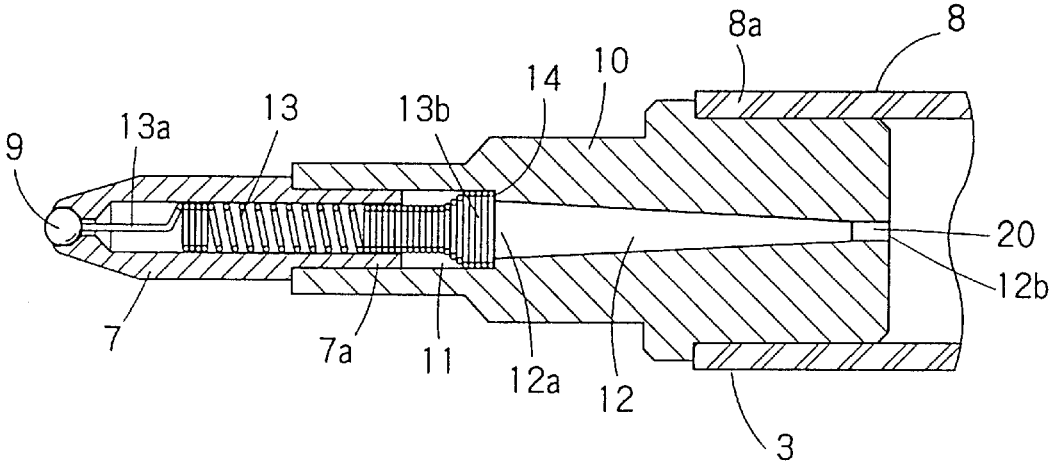
FIG. 3 is an enlarged sectional view of a forward end of the ballpoint pen refill shown in FIG. 2.

As shown in FIGS. 2 and 3, the ballpoint pen refill 3 has an ink-accommodating tube 8, and a tip holder 10 fitted in a forward end 8*a* of the ink-accommodating tube 8. A rear end 7*a* of the ballpoint pen tip 7 is fitted in an aperture 11 formed in a forward end of the tip holder 10. The ballpoint pen tip 7 holds a ball 9 for free rotation and the ball 9 projects partly from the forward end of the ballpoint pen tip 7. An ink passage 12 is formed in the tip holder 10 so as to extend rearward from the aperture 11 of the tip holder 10.

The ink passage 12 is tapered rearward and has a large open forward end 12*a* and a small open rear end 12*b*. A straight restricting passage 20 has a sectional area in the range of 0.4 to 0.8 $mm^2$ which is measured perpendicular to the axis of the ink-accommodating tube 8.

A coil spring 13 extends in the ballpoint pen tip to press the ball 9 forward so that the ball 9 is kept in close contact with the inner surface of a forward end of the ballpoint pen tip 7. The coil spring 13 has a straight forward part 13*a* set in contact with the ball 9 from behind the ball 9.

The aperture 11 is formed to have a diameter greater than that of the ink passage 12 so that a shoulder 14 is formed at the joint between the aperture 11 and the ink passage 12 to hold the rear end 13*b* of the coil spring 13 on the shoulder 14.

As shown in FIG. 2, a water-based ink 15 is contained in the ink-accommodating tube 8. The water-based ink 15 contains a thixotropic agent and has a viscosity at a rate of shear of 1.9 $sec^{-1}$ at 20° C. in the range of 900 to 2,500 mPa·s. An ink follower 16 of a greaselike material to prevent the reverse flow of the water-based ink 15 is put in the ink-accommodating tube in contact with the rear end of the water-based ink 15. The ink follower 16 follows the advancement of the rear end of the water-based ink 15 as the water-based ink 15 is consumed. A tail plug 18 provided with a vent hole 17 is fitted in the open rear end part 8*b* of the ink-accommodating tube 8. A space inside the ink-accommodating tube 8 communicates with a space outside the same by means of the vent hole 17.

The thixotropic agent is a mixture of a crosslinked acrylic acid polymer, xanthane gum and succinoglycan, and the thixotropic agent concentration of the water-based ink 15 is in the range of 0.2 to 0.8% by weight.

The forward end of the spring 13 is in direct contact with the ball 9 to press the ball 9 in this embodiment and other embodiments which will be described hereinafter. A pressure piece may be interposed between the ball 9 and the coil spring 13, or the coil spring 13 may be omitted so as not to apply any pressure to the ball 9 by the coil spring 13.

Second Embodiment

A retractable ballpoint pen of a second embodiment according to the present invention will be described with reference to FIG. 4.

The retractable ballpoint pen in this embodiment, similar to that of the first embodiment, is provided with a retracting mechanism having a rotary cam and a cam groove formed in the inner side surface of a barrel.

Figure 4:
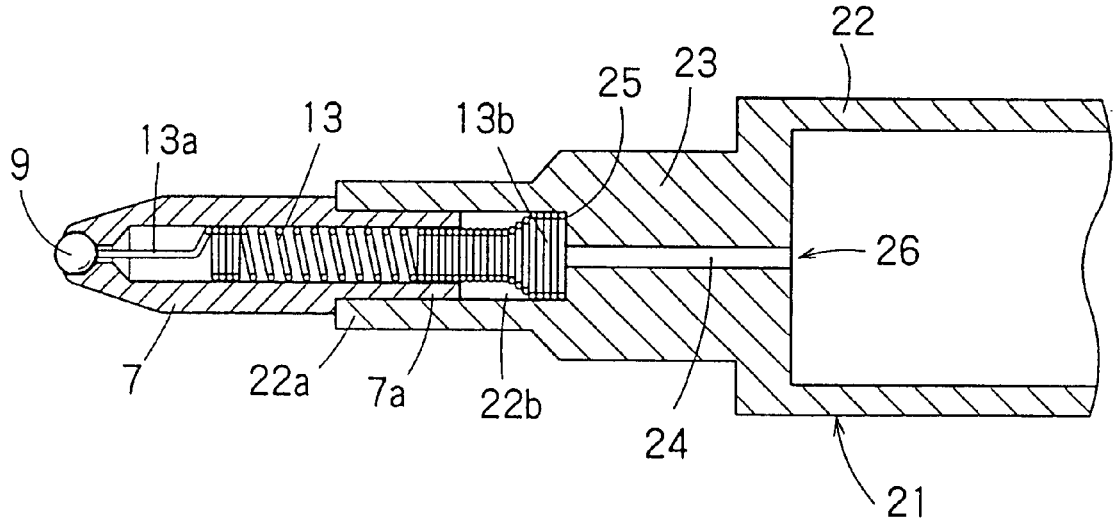
FIG. 4 is an enlarged sectional view of a forward end of a ballpoint pen refill contained in a barrel included in a retractable ballpoint pen of a second embodiment according to the present invention.

As shown in FIG. 4, a ballpoint pen refill 21 for the retractable ballpoint pen of this embodiment has an ink-accommodating tube 22 integrally provided with a tip holding part 23. A ballpoint pen tip 7 holding a ball 9 for free rotation is fitted in an aperture 22*b* formed in a forward end part 22*a* of the tip holding part 23. The ball 9 is partly projected from the forward end of the ballpoint pen tip 7.

The tip holding part 23 is provided with an ink passage 24 aligned with the axis of the ink-accommodating tube 22. The ink passage 24 is straight and has a sectional area in the range of 0.4 to 0.8 $mm^2$. The ink passage 24 serves also as a restricting passage 26 that limits the flow of a water-based ink.

A coil spring 13, similar to that in the first embodiment, extends in the ballpoint pen tip 7 to press the ball 9 forward. The coil spring 13 has a forward part 13*a* set in contact with the ball 9 from behind the ball 9. A shoulder 25 is formed between the aperture 22*b* and the ink passage 24 of a diameter smaller than that of the aperture 22*b*. The rear end 13*b* of the coil spring 13 is held on the shoulder 25.

A water-based ink similar to that in the first embodiment is contained in the ink-accommodating tube 8. An ink follower of a greaselike material is put in the ink-accommodating tube 22. A tail plug similar to that of the first embodiment provided with a vent hole is fitted in the open rear end part (not shown) of the ink-accommodating tube 22. A space inside the ink accommodating tube 22 communicates with a space outside the same by means of the vent hole.

Third Embodiment

A retractable ballpoint pen of a third embodiment according to the present invention will be described hereinafter with reference to FIG. 5.

The retractable ballpoint pen of this embodiment, similar to that in the first embodiment, is provided with a retracting mechanism having a rotary cam and a cam groove formed in the inner side surface of a barrel.

Figure 5:
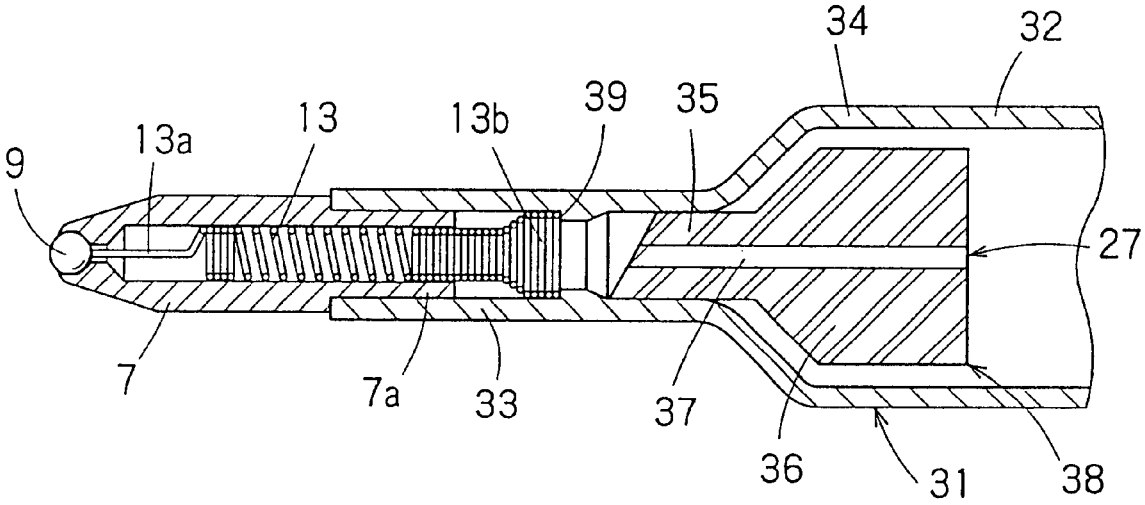
FIG. 5 is an enlarged sectional view of a forward end of a ballpoint pen refill contained in a barrel included in a retractable ballpoint pen of a third embodiment according to the present invention.

As shown in FIG. 5, a ballpoint pen refill 31 for the retractable ballpoint pen in this embodiment has an ink-accommodating tube 32. The ink tube 32 has a reduced-diameter portion 33 at the forward end and a body portion 34 having a diameter greater than that of the reduced-diameter portion 33 extending behind the reduced-diameter portion 33. A ballpoint pen tip 7 holding a ball 9 for free rotation is fitted in an aperture formed in the forward end of the reduced-diameter portion 33. The ball 9 is partly projected from the tip of the ballpoint pen tip 7.

A flow control member 38 is placed in the ink-accommodating tube 32. The flow control member 38 has a forward reduced-diameter portion 35 of a small diameter and a body portion 36 formed integrally with the reduced-diameter portion 35. The reduced-diameter portion 35 is fitted in the reduced-diameter portion 33 of the ink-accommodating tube 32. The body portion 36 is disposed in the body portion 34 of the ink-accommodating tube 32.

The flow control member 38 is provided internally with a straight ink passage 37 extending between its front and rear ends and having a cross-sectional area in the range of 0.4 to 0.8 $mm^2$. The ink passage 37 serves also as a restricting passage 27 for limiting the flow of a water-based ink.

A coil spring 13, similar to that in the first embodiment, extends in the ballpoint pen tip 7 to press the ball 9 forward. The coil spring 13 has a forward part 13*a* set in contact with the ball 9 from behind the ball 9. A shoulder 39 is formed inside the reduced-diameter portion 33 of the ink-accommodating tube 32. The rear end 13*b* of the coil spring 13 is held on the shoulder 39.

A water-based ink and an ink follower similar to those of the first embodiment are contained in the ink-accommodating tube 32. A tail plug provided with a vent hole similar to that of the first embodiment is fitted in the open rear end part of the ink-accommodating tube 32. A space inside the ink-accommodating tube 32 communicates with a space outside the same by means of the vent hole.

Fourth Embodiment

A retractable ballpoint pen of a fourth embodiment according to the present invention will be described hereinafter with reference to FIGS. 6 and 7.

The retractable ballpoint pen of this embodiment, similar to that in the first embodiment, is provided with a retracting mechanism having a rotary cam and a cam groove formed in the inner side surface of a barrel.

Figure 6:
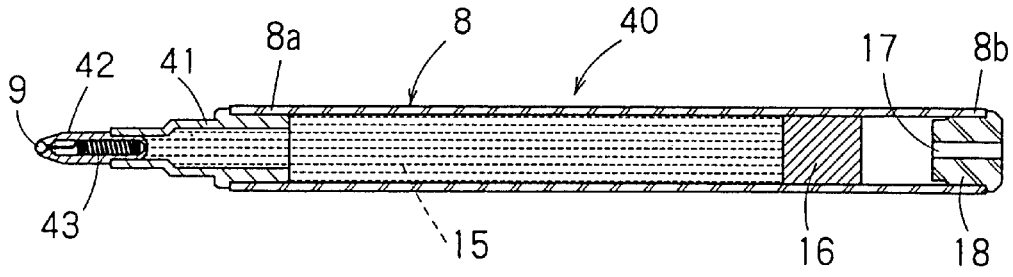
FIG. 6 is a longitudinal sectional view of a ballpoint pen refill contained in a barrel included in a retractable ballpoint pen of a fourth embodiment according to the present invention.
Figure 7:
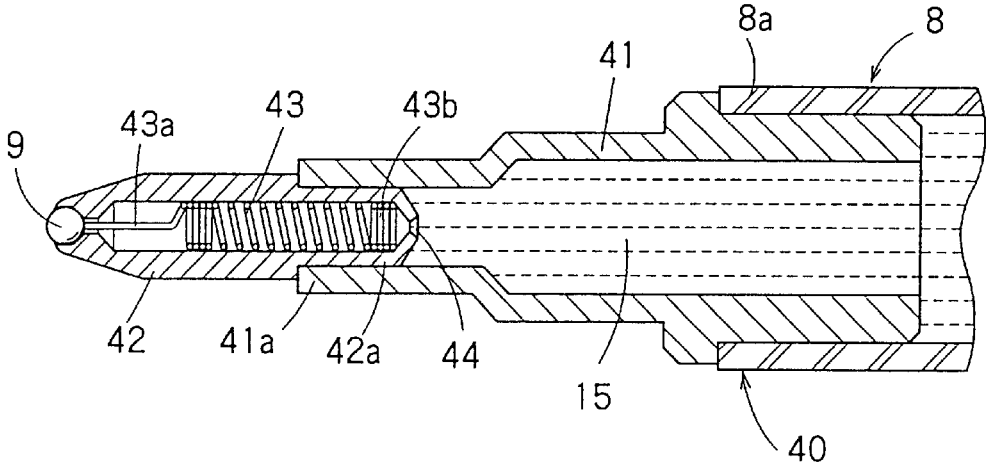
FIG. 7 is an enlarged sectional view of a forward end of the ballpoint pen refill shown in FIG. 6.

As shown in FIGS. 6 and 7, a ballpoint pen refill 40 is formed by fitting a tip holder 41 in a forward end 8*a* of an ink-accommodating tube 8 and by fitting a rear end 42*a* of a ballpoint pen tip 42 in a forward end 41 a of the tip holder 41. A ball 9 is held for free rotation in the ballpoint pen tip 42 so as to project partly from the ballpoint pen tip 42.

A water-based ink 15 and a greaselike ink follower 16, which are similar to those of the first embodiment, are contained in the ink-accommodating tube 8. A tail plug 18 provided with a vent hole 17 is fitted in the open rear end 8*b* of the ink-accommodating tube 8. A space inside the ink-accommodating tube 8 communicates with a space outside the same by means of the vent hole 17.

As shown in FIG. 7, a rear end of the ballpoint pen tip 42 has a reduced-diameter restricting passage 44 having a cross-sectional area in the range of 0.4 to 0.8 $mm^2$ for controlling the flow of the water-based ink 15.

A coil spring 43 extends in the ballpoint pen tip 42 to press the ball 9 forward so that the ball is kept in close contact with the inner surface of a forward end of the ballpoint pen tip 42. The coil spring 43 has a straight forward part 43*a* set in contact with the ball 9 from behind the ball 9. The coil spring 43 has a rear end 43*b* held against the inner surface of a portion of the rear end of the ballpoint pen tip 42 forming the restricting passage 44.

Figure 8:
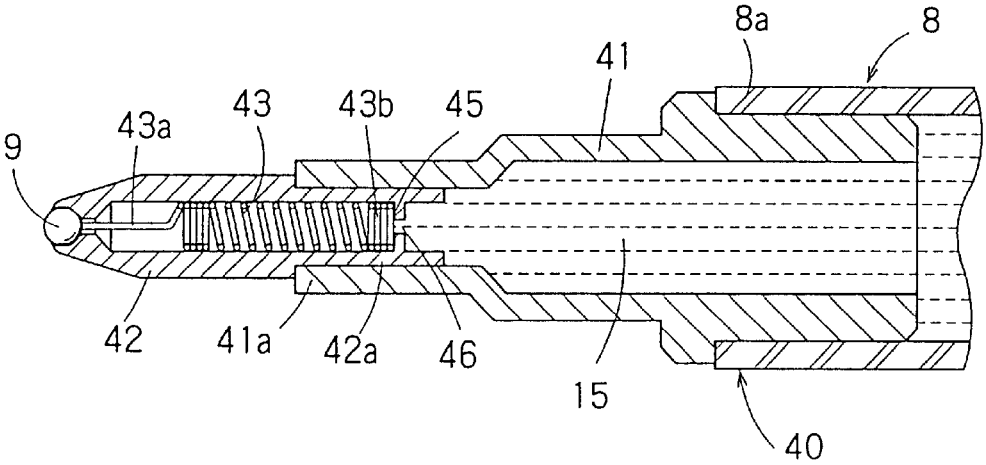
FIG. 8 is an enlarged sectional view of a forward end of a ballpoint pen refill employed in a modification of the fourth embodiment of the present invention.

FIG. 8 shows a modification of this embodiment. In this modification, a projection 45 is formed so as to project from the inner surface of a rear end of a ballpoint pen tip 42 so as to form a restricting passage 46 having a cross-sectional area in the range of 0.4 to 0.8 $mm^2$.

In the fourth embodiment and its modification, the tip holder 41 is fitted in the forward end part 8*a* of the ink-accommodating tube 8, and the ballpoint pen tip 42 is fitted in the forward end part of the tip holder 41. However, the ballpoint pen tip 42 may be fitted directly in the forward part of the ink-accommodating tube 32 having the reduced-diameter portion 33 and the body portion 34 shown in FIG. 5.

Fifth Embodiment

A retractable ballpoint pen of a fifth embodiment according to the present invention will be described with reference to FIG. 9. The retractable ballpoint pen of this embodiment is provided with a ballpoint pen tip in a modification of the ballpoint pen tip of the retractable ballpoint pen in the fourth embodiment, and is the same in other respects as the retractable ballpoint pen in the fourth embodiment.

Figure 9:
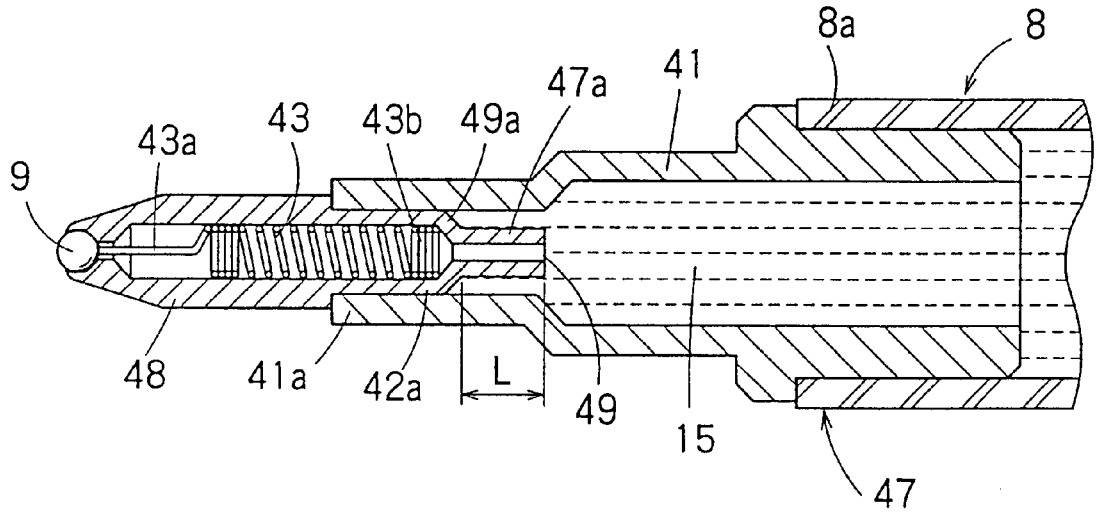
FIG. 9 is an enlarged sectional view of a forward end of a ballpoint pen refill contained in a barrel included in a retractable ballpoint pen of a fifth embodiment according to the present invention.

Referring to FIG. 9, a ballpoint pen tip 48 included in a ballpoint pen refill 47 of the fifth embodiment has a restricting passage 49 with a sectional area in the range of 0.4 to 0.8 $mm^2$. The restricting passage 49 is formed by pressing and reducing the rear end 47*a* of the ballpoint pen tip 48 along a predetermined length L.

A coil spring 43 included in the ballpoint pen tip 48 has a rear end 43*b* held against the inner surface of a transitional part 49*a* of the ballpoint pen tip 48 formed in front of the restricting passage 49.

The ballpoint pen tip 48 of this embodiment, similar to that of the fourth embodiment, may be fitted in a forward end of an ink-accommodating tube 32 having a reduced-diameter portion 33 and a body portion 34 shown in FIG. 5.

Sixth Embodiment

A retractable ballpoint pen of a sixth embodiment according to the present invention will be described with reference to FIG. 10. The retractable ballpoint pen of this embodiment is provided with a ballpoint pen tip in a modification of the ballpoint pen tip and the ink-accommodating tube of the retractable ballpoint pens in the fourth and fifth embodiment, and is the same in other respects as the retractable ballpoint pens in the fourth and the fifth embodiment.

Figure 10:
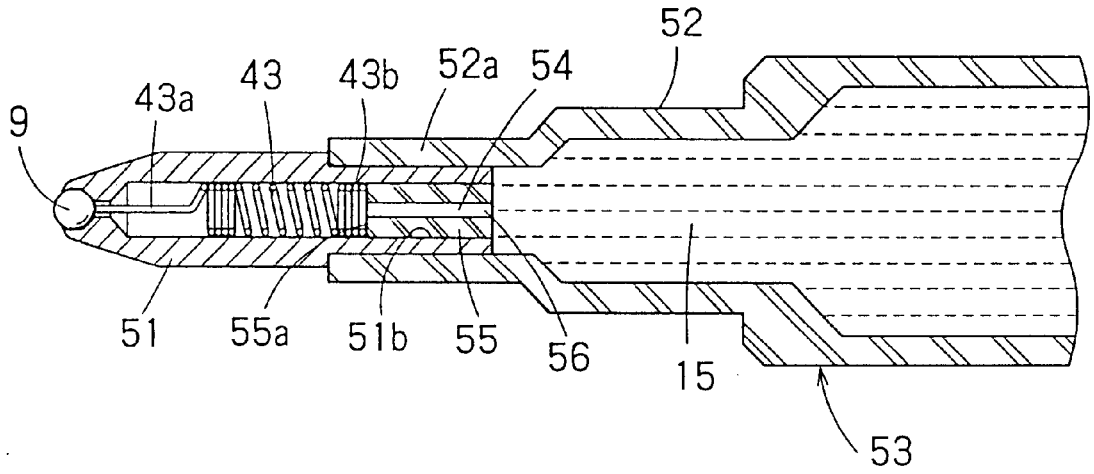
FIG. 10 is an enlarged sectional view of a forward end of a ballpoint pen refill contained in a barrel included in a retractable ballpoint pen of a sixth embodiment according to the present invention.

Referring to FIG. 10, a ballpoint pen refill 53 employed in this embodiment has an ink-accommodating tube 52 having a forward reduced-diameter portion 52*a*, and a ballpoint pen tip 51 fitted in the forward end part 52*a* of the ink-accommodating tube 52. A tubular flow control member 55 is fitted in an open rear end of the ballpoint pen tip 51. A straight, axial connecting hole 54 is formed through the flow control member 55.

The connecting hole 54 of the flow control member 55 has a cross-sectional area in the range of 0.4 to 0.8 $mm^2$. The connecting hole 54 serves also as a restricting passage 56 for limiting the flow of a water-based ink 15.

A coil spring 43 has a rear end part 43*b* held against the forward end surface 55*a* of the flow control member 55 fitted in the ballpoint pen tip 51.

Figure 11:
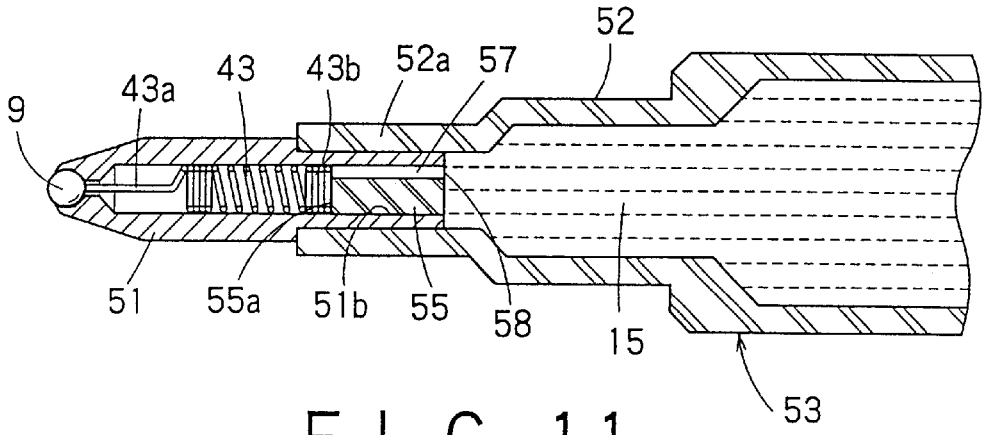
FIG. 11 is an enlarged sectional view of a forward end of a ballpoint pen refill employed in a first modification of the sixth embodiment of the present invention.

FIG. 11 shows a first modification of this embodiment. In the first modification, the flow control member 55 is provided with a connecting groove 57 having a cross-sectional area in the range of 0 .4 to 0.8 $mm^2$ instead of the connecting hole 54. The connecting groove 57 serves as a restricting passage 58.

Figure 12:
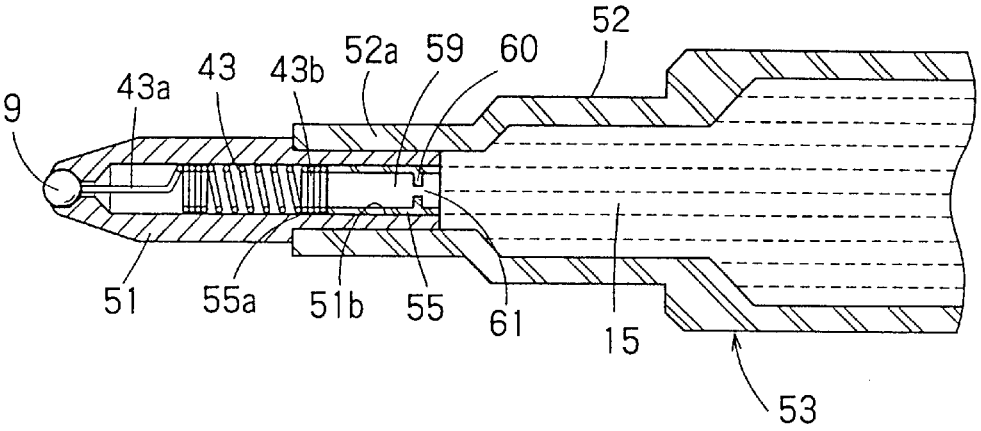
FIG. 12 is an enlarged sectional view of a forward end of a ballpoint pen refill employed in a second modification of the sixth embodiment of the present invention.

FIG. 12 shows a second modification of this embodiment. In the second modification, the flow control member 55 is provided with a large connecting hole 59 of a diameter greater than that of the connecting hole 54. A projection 60 projects from the inner surface of the connecting hole 59 to form a restricting passage 61 having a cross-sectional area in the range of 0.4 to 0.8 $mm^2$.

Figure 13:
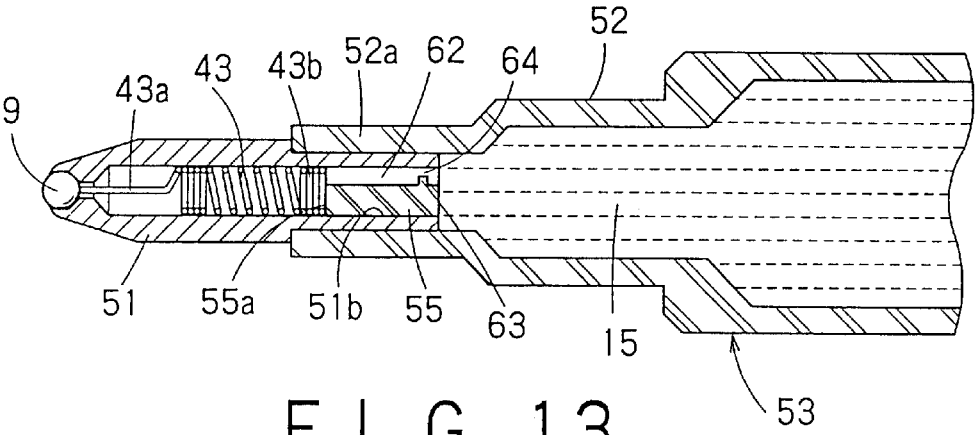
FIG. 13 is an enlarged sectional view of a forward end of a ballpoint pen refill employed in a third modification of the sixth embodiment of the present invention.

FIG. 13 shows a third modification of this embodiment. In the third modification, the flow control member 55 is provided with a connecting groove 62 of a sectional area greater than that of the connecting groove 56 shown in FIG. 11. A projection 63 is formed on the inner surface of the connecting groove 62 to form a restricting passage 64 of a sectional area in the range of 0.4 to 0.8 $mm^2$.

In this embodiment and its modifications, the ballpoint pen tip 51 is fitted in a front end of the ink-accommodating tube 52. The ballpoint pen tip 51 may be fitted in a tip holder 41 fitted in a forward end part 8*a* of an ink-accommodating tube 8 shown in FIG. 7.

Examples of the foregoing retractable ballpoint pens according to the present invention will be described hereinafter. The examples are those of the first embodiment shown in FIGS. 1 to 3 employing the following water-based ink as the water-based ink 15.

EXAMPLE 1

A water-based ink 15 of the following composition was prepared.

| | |
|---|---|
| Direct Black 154 | 7.5% wt. |
| Ethylene glycol | 25.0% wt. |
| Rust-preventive lubricant | 1.0% wt. |
| pH regulator | 2.0% wt. |
| Antibacterial agent | 0.5% wt. |
| Crosslinking acrylic acid polymer | 0.25% wt. |
| Xanthan gum | 0.10% wt. |
| Succinoglycan | 0.05% wt. |
| Ion-exchange water | 63.6% wt. |

A mixture of 63.6% by weight of ion-exchange water and 25.0% by weight of ethylene glycol was mixed and stirred by a hot magnetic stirrer at 60° C. Then, 1.0% by weight of PLYSURF A-208S® (Daiuchi Kogyo Seiyaku K. K.), i.e., a phosphoric ester surface active agent as a rust-preventive lubricant, 2.0% by weight of triethanolamine as a pH regulator, 0.5% by weight of 1,2-benzoisothiazoline-3-on and 7.5% by weight of Direct Black 154 as a dye were mixed in the mixture and stirred so that those components were dissolved completely to obtain a mixed liquid.

Then, 0.25% by weight of HIVISWAKO 104® (Wako Junyaku Kogyo K. K.) as cross linking acrylic acid copolymer, 0.10% by weight of KELZAN® (Sanshyo K. K.) as xanthan gum and 0.05% by weight of MEYPOLY® (Sanshyo K. K.)as succinoglycan were mixed in the mixed liquid and mixed and stirred in a homogeneous state by a homogenizer to obtain the water-based ink 15.

The viscosity of the water-based ink 15 at a rate of shear of 1.9 $sec^{-1}$ at 20° C. measured by an E-type viscometer was 900 mPa·s.

The ink follower 16 was prepared by mixing and stirring the following ingredients.

| | |
|---|---|
| Silicone oil (KF96-5000) | 46.0% wt. |
| Silicone oil (KF96-3000) | 45.7% wt. |
| Hydrophobic silica | 8.0% wt. |
| Polyester plasticizer (SP-105) | 0.3% wt. |

The water-based ink 15 and the ink follower 16 thus prepared are filled in the ballpoint pen refill 3 employed in the first embodiment. The open forward end 12*a* of the ink passage 12 formed in the tip holder 10 was formed in a sectional area of 1.54 $mm^2$ and the straight restricting passage 20 contiguous with the open rear end of the ink passage was formed in a sectional area of 0.4 $mm^2$.

EXAMPLES 2 to 8

Water-based inks 15 of compositions tabulated in Table 1 were prepared by the same procedure as that used in Example 1. The water-based inks 15 were filled in the ink-accommodating tubes 8 of ballpoint pen refills 3 similar to the ballpoint pen refill 3 of the first embodiment. The ballpoint pen refills 3 had tip holders 10 provided with ink passages 12 having open rear ends 12*b* with restricting passage 20 of cross-sectional areas tabulated in Table 1, respectively. Viscosities of the water-based inks at a rate of shear of 1.9 $sec^{-1}$ at 20° C. measured by an E-type viscometer are tabulated in Table 1.

TABLE 1

| Examples | 1 | 2 | 3 | 4 | 5 | 6 | 7 | 8 |
|---|---|---|---|---|---|---|---|---|
| Direct Black 154 | 7.5 | 7.5 | 7.5 | 7.5 | 7.5 | 7.5 | 7.5 | 7.5 |
| Ethylene Glycol | 25.0 | 25.0 | 25.0 | 25.0 | 25.0 | 25.0 | 25.0 | 25.0 |
| Rust-preventive lubricant | 1.0 | 1.0 | 1.0 | 1.0 | 1.0 | 1.0 | 1.0 | 1.0 |
| pH regulator | 2.0 | 2.0 | 2.0 | 2.0 | 2.0 | 2.0 | 2.0 | 2.0 |
| Antibacterial agent | 0.5 | 0.5 | 0.5 | 0.5 | 0.5 | 0.5 | 0.5 | 0.5 |
| Cross linking acrylic acid polymer | 0.25 | 0.25 | 0.2 | 0.2 | 0.17 | 0.8 | — | — |
| Xanthan gum | 0.1 | 0.1 | 0.18 | 0.18 | 0.15 | — | 0.5 | — |
| Succinoglycan | 0.05 | 0.05 | 0.13 | 0.13 | 0.13 | — | — | 0.3 |
| Ion-exchange water | Remainder | Remainder | Remainder | Remainder | Remainder | Remainder | Remainder | Remainder |
| Ink viscosity (mPa · s) | 900 | 900 | 2500 | 2500 | 2000 | 900 | 1700 | 2000 |
| Minimum sectional area of ink passage ($mm^2$) | 0.4 | 0.8 | 0.4 | 0.8 | 0.8 | 0.4 | 0.4 | 0.4 |
| Tip ink leakage | ○ | ○ | ◎ | ◎ | ◎ | ○ | ◎ | ◎ |
| Ink back-flow due | ○ | ○ | ◎ | ○ | ○ | ○ | ◎ | ◎ |

TABLE 1-continued

| Examples | 1 | 2 | 3 | 4 | 5 | 6 | 7 | 8 |
|---|---|---|---|---|---|---|---|---|
| to shocks | | | | | | | | |
| Writing performance | ◎ | ◎ | ○ | ○ | ◎ | ◎ | ○ | ○ |

COMPARATIVE EXAMPLES 1 to 6

Comparative experiments were conducted to compare Comparative examples 1 to 6 and 1 to 8. Water-based inks of composition tabulated in Table 2 were prepared for Comparative examples 1 to 6 by the same procedure as that for preparing the water-based ink of the first embodiment. The water-based inks were filled in the ink-accommodating tubes 8 of ballpoint pen refills 3 similar to the ballpoint pen refill 3 of the first embodiment. The ballpoint pen refills 3 had tip holders 10 provided with ink passages 12 having open rear ends 12*b* of sectional areas tabulated in Table 2, respectively. Viscosities of the water-based inks at a rate of shear of 1.9 $sec^{-1}$ at 20° C. measured by an E-type viscometer are tabulated in Table 2.

TABLE 2

| Comparative Examples | 1 | 2 | 3 | 4 | 5 | 6 |
|---|---|---|---|---|---|---|
| Direct Black 154 | 7.5 | 7.5 | 7.5 | 7.5 | 7.5 | 7.5 |
| Ethylene glycol | 25.0 | 25.0 | 25.0 | 25.0 | 25.0 | 25.0 |
| Rust-preventive lubricant | 1.0 | 1.0 | 1.0 | 1.0 | 1.0 | 1.0 |
| pH regulator | 2.0 | 2.0 | 2.0 | 2.0 | 2.0 | 2.0 |
| Antibacterial agent | 0.5 | 0.5 | 0.5 | 0.5 | 0.5 | 0.5 |
| Crosslinking acrylic acid polymer | 0.25 | 0.25 | 0.2 | 0.2 | — | — |
| Xanthan gum | 0.1 | 0.08 | 0.18 | 0.18 | 0.35 | 0.65 |
| Succinoglycan | 0.05 | 0.05 | 0.13 | 0.14 | — | — |
| Ion-exchange water | Remainder | Remainder | Remainder | Remainder | Remainder | Remainder |
| Ink viscosity (mPa · s) | 900 | 800 | 2500 | 2600 | 900 | 2500 |
| Minimum sectional area of ink passage ($mm^2$) | 0.3 | 0.4 | 0.9 | 1.3 | 0.3 | 0.9 |
| Tip ink leakage | ○ | ○ | ○ | ◎ | ○ | ○ |
| Ink back-flow due to shocks | ○ | X | X | ○ | ○ | X |
| Writing performance | X | X | X | X | X | X |

Tests and Evaluation

The retractable ballpoint pens in Examples 1 to 8 and Comparative examples 1 to 6 were subjected to the following tests for evaluation.

Tip Ink Leakage: The retractable ballpoint pens were kept in an environment of 30° C. and 80% RH for two hours with the ballpoint pens tips 7 pointed downward, and then the ballpoint pen tips 7 were examined for ink leakage. In Tables 1 and 2, double circles (◎) indicate no ink leakage, circles (○) indicate slight ink leakage wetting the extremity of the ballpoint pen tip 7 and crosses (X) indicate ink leakage forming an ink droplet on the extremity of the ballpoint pen tip 7.

Ink Back-Flow Due to Shocks: The ballpoint pen 1 was dropped ten times on a cedar plate from a position at a height of 1 m with the ballpoint pen tip 7 pointed upward. Then, the ballpoint pen 1 was used for writing to determine the degree of ink back-flow. In Tables 1 and 2, double circles (◎) indicate ballpoint pens that started satisfactorily drawing a line after being moved 3 cm or below, circles (○) indicate ballpoint pens that started satisfactorily drawing a line after being moved for a distance in the range of 3 to 5 cm, and crosses (X) indicate ballpoint pens that were unable to start satisfactorily drawing a line before the same were moved for a distance beyond 5 cm.

Writing Performance: In Tables 1 and 2, double circles (◎) indicate ballpoint pens that were satisfactory in writing performance and did not draw scratchy or patchy lines at all, circles (○) indicate ballpoint pens that were satisfactory but not perfectly satisfactory, and crosses (X) indicate ballpoint pens that were obviously not satisfactory in ink flow and drew scratchy or patchy lines.

The results of evaluation of Examples and Comparative examples are shown in Tables 1 and 2.

In the ballpoint pen in Comparative example 1, although the ink had a viscosity at a rate of shear of 1.9 $sec^{-1}$ at 20° C. (hereinafter referred to simply as "ink viscosity") equal to the lower limit ink viscosity (900 mPa·s), the ink was not able to flow smoothly to the extremity of the ballpoint pen tip 7 because the minimum cross-sectional area of the open rear end 12*b* of the ink passage 12 formed in the tip holder 10 is excessively small (0.3 $mm^2$). The open rear end 12*b* was effective in preventing leakage of the ink from the tip and back-flow of the ink into the ink-accommodating tube. However, the ink could not flow smoothly, lines became patchy when the same were drawn continuously and the writing performance of the ballpoint pen in Comparative example 1 was unsatisfactory.

In the ballpoint pen in Comparative example 2, the open rear end 12*b* of the ink passage 12 has a minimum cross-sectional area equal to the lower limit sectional area (0.4 $mm^2$). Therefore, the ink scarcely leaked from the tip.

However, since the ink viscosity was excessively low (800 mPa·s), the ink could not withstand the shocks causing ink back-flow. Thus, the ink was withdrawn and writing performance was unsatisfactory.

In the ballpoint pen in Comparative example 3, the minimum cross-sectional area of the open rear end 12*b* of the ink passage 12 was as large as 0.9 $mm^2$. Consequently, the ink could not withstand the shocks causing ink back-flow and significant ink back-flow occurred despite the high ink viscosity equal to the upper limit viscosity of 2500 mPa·s.

In the ballpoint pen in Comparative example 4, the open rear end 12*b* of the ink passage 12 had a large minimum sectional area of 1.3 $mm^2$, and the ink had a high ink viscosity of 2600 mPa·s. Although the ink could flow satisfactorily to the extremity of the ballpoint pen tip 7 because the open rear end 12*b* had a large sectional area, scratch lines were drawn, writing feeling was bad and writing performance was unsatisfactory because the ink had the high viscosity. Although the ballpoint pen had an excellent ability to prevent ink leakage and to withstand shocks, the ballpoint pen cannot be used as a writing instrument.

In the ballpoint pens in Comparative examples 5 and 6, the inks contained only xanthan gum as a thixotropic agent. The sectional area of 0.3 $mm^2$ of the open rear end 12*b* of the ink passage of the ballpoint pen in Comparative example 5 was excessively small and the sectional area of 0.9 $mm^2$ of the open rear end 12*b* of the ink passage of the ballpoint pen in Comparative example 6 was excessively large. Consequently, the evaluation of Comparative example 5 was the same as that of Comparative example 1, and the evaluation of Comparative example 6 was the same as that of Comparative example 3. It is known from the results of evaluation that ink leakage, ink back-flow and writing performance are not dependent on the type of the thixotropic agents.

Industrial Applicability

The present invention is widely applicable to a retractable ballpoint pen provided with a ballpoint pen refill containing a water-based ink containing a thixotropic agent.

What is claimed is:

1. A retractable ballpoint pen comprising:

a ballpoint pen refill having an ink-accommodating tube, a ballpoint pen tip connected to a forward end of the ink-accommodating tube, and a ball held for free rotation in a forward end of the ballpoint pen tip;

a barrel having an open forward end and containing the ballpoint pen refill;

a retracting mechanism for projecting and retracting a forward end of the ballpoint pen tip through the open forward end of the barrel;

a water-based ink contained in the ink-accommodating tube, the water-based ink containing a thixotropic agent and having a viscosity at a rate of shear of 1.9 $sec^{-1}$ at 20° C. in the range of 900 to 2500 mPa·s; and a restricting passage for restricting a flow of the water-based ink, the restricting passage being formed in an ink passage arranged to allow the water-based ink to flow from the ink-accommodating tube to the ball of the ballpoint pen refill, a cross-sectional area of the restricting passage measured perpendicular to an axis of the ink-accommodating tube being in a range of 0.4 $mm^2$ to 0.8 $mm^2$.

2. The retractable ballpoint pen according to claim 1, further comprising a tip holder attached to the forward end of the ink-accommodating tube, the tip holder holding a rear end of the ballpoint pen tip in a forward end of the tip holder, the ink passage being formed in the tip holder;

wherein the restricting passage is formed by reducing at least a part of the ink passage.

3. The retractable ballpoint pen according to claim 2, wherein the restricting passage is formed in a rear end of the ink passage.

4. The retractable ballpoint pen according to claim 3, wherein the ink passage is tapered downward from a front end of the tip holder toward a rear end of the tip holder, and the restricting passage is formed at a narrowest section at a rear end of the ink passage.

5. The retractable ballpoint pen according to claim 4, further comprising a coil spring for pressing the ball forward against an inner surface of the forward end of the ballpoint pen tip;

wherein the tip holder has an aperture at its forward end, the rear end of the ballpoint pen tip is fitted in the aperture, the aperture of the tip holder is connected to the ink passage, the aperture is formed to have a diameter greater than a diameter of the ink passage so as to form a shoulder at a joint between the aperture and the ink passage, a rear end of the coil spring is held against the shoulder.

6. The retractable ballpoint pen according to claim 3, further comprising a coil spring for pressing the ball forward against an inner surface of the forward end of the ballpoint pen tip;

wherein the tip holder has an aperture at its forward end, the rear end of the ballpoint pen tip is fitted in the aperture, the aperture of the tip holder is connected to the ink passage, the aperture is formed to have a diameter greater than a diameter of the ink passage so as to form a shoulder at a joint between the aperture and the ink passage, a rear end of the coil spring is held against the shoulder.

7. The retractable ballpoint pen according to claim 2, further comprising a coil spring for pressing the ball forward against an inner surface of the forward end of the ballpoint pen tip;

wherein the tip holder has an aperture at its forward end, the rear end of the ballpoint pen tip is fitted in the aperture, the aperture of the tip holder is connected to the ink passage, the aperture is formed to have a diameter greater than a diameter of the ink passage so as to form a shoulder at a joint between the aperture and the ink passage, a rear end of the coil spring is held against the shoulder.

8. The retractable ballpoint pen according to claim 1, wherein the forward end of the ink-accommodating tube has an integrally-formed tip holding part, and wherein the ink passage is formed in the tip holding part, and the restricting passage is formed by reducing at least a part of the ink passage of the tip holding part.

9. The retractable ballpoint pen according to claim 1, further comprising a flow control member, the ink passage being formed in the flow control member, wherein the ink-accommodating tube has a small-diameter section formed at the forward end, and has a large-diameter section formed at the rear of the small-diameter section, the large-diameter section has a diameter larger than a diameter of the small-diameter section, the ballpoint pen tip is attached to a forward end of the small-diameter section, the flow control member is fitted in the small-diameter section, and the restricting passage is formed by setting a smallest cross-sectional area of the ink passage of the flow control member to a value in a range of 0.4 $mm^2$ to 0.8 $mm^2$.

10. The retractable ballpoint pen according to claim 1, wherein the ballpoint pen tip is attached directly to a forward end of the ink-accommodating tube or to a forward end of a tip holder attached to the forward end of the ink-accommodating tube, and the restricting passage is formed in the ballpoint pen tip.

11. The retractable ballpoint pen according to claim 10, wherein the restricting passage is formed by bending a rear edge of the ballpoint pen tip toward a central longitudinal axis of the ballpoint pen tip.

12. The retractable ballpoint pen according to claim 10, wherein the restricting passage is formed by reducing a diameter of a rear end of the ballpoint pen tip along a predetermined length.

13. The retractable ballpoint pen according to claim 10, wherein the restricting passage is formed by forming a projection projecting toward a central longitudinal axis of the ballpoint pen tip from an inner surface of a rear end of the ballpoint pen tip.

14. The retractable ballpoint pen according to claim 1, further comprising a flow control member fitted in an open rear end of the ballpoint pen tip, wherein the ink passage including the restricting passage is formed in the flow control member.

15. The retractable ballpoint pen according to claim 14, wherein the restricting passage is a continuous hole or a continuous groove extending from a forward end of the flow control member to a rear end thereof, and the hole or the groove has a minimum cross-sectional area in the range of 0.4 $mm^2$ to 0.8 $mm^2$.

16. The retractable ballpoint pen according to claim 14, wherein the restricting passage is formed by a projection formed on an inner surface of a continuous hole or a continuous groove extending from a forward end of the flow control member to a rear end thereof.

17. The retractable ballpoint pen according to claim 1, wherein the thixotropic agent includes a crosslinking acrylic acid polymer, a xanthane gum and a succinoglycan, and a concentration of the thixotropic agent in the ink is in the range of 0.2% to 0.8% by weight.

* * * * *